US005172641A

United States Patent [19]

Auer

[11] Patent Number: 5,172,641

[45] Date of Patent: Dec. 22, 1992

[54] TABLE WITH MOVABLE WORKING SURFACE

[75] Inventor: Gerhard Auer, Hermersberg, Fed. Rep. of Germany

[73] Assignee: Wasa Massivholzmoebel GmbH, Geiselberg/Pfalz, Fed. Rep. of Germany

[21] Appl. No.: 782,992

[22] Filed: Oct. 28, 1991

[30] Foreign Application Priority Data

Oct. 26, 1990 [DE] Fed. Rep. of Germany ... 9014828[U]
Jul. 13, 1991 [DE] Fed. Rep. of Germany ..... 4123240

[51] Int. Cl.[5] ..... A47F 5/12

[52] U.S. Cl. ..... 108/5; 108/6; 248/396

[58] Field of Search ..... 108/1, 3, 4, 5, 6, 157; 248/396, 394

[56] References Cited

U.S. PATENT DOCUMENTS

| | | | |
|---|---|---|---|
| 1,793,709 | 2/1931 | Meyers | 108/157 |
| 2,194,889 | 3/1940 | De Lisle | 108/5 |
| 2,686,096 | 8/1954 | Barnes, Jr. | 108/157 |
| 4,781,126 | 11/1988 | Lochridge | 108/6 |
| 5,036,776 | 8/1991 | Veal et al. | 108/7 |

FOREIGN PATENT DOCUMENTS

| | | | |
|---|---|---|---|
| 3301467 | 7/1984 | Fed. Rep. of Germany | 108/1 |

*Primary Examiner*—Jose V. Chen
*Attorney, Agent, or Firm*—Panitch Schwarze Jacobs & Nadel

[57] ABSTRACT

A table with a movable working surface is supported on a table frame with legs. A running rail arrangement is provided on the table frame and cooperates in a form fitting relationship with a pair of edge rails extending from the working surface. The running rail arrangement is divided into two running rail elements. A first running rail element is rigidly fixed to the table frame. A second running rail element is rotatably mounted to the table frame at a location adjacent to the first running rail element. The first running rail element has a sloped bearing surface on which the second running rail element is supported when the working surface is in a horizontal position. Each edge rail includes a holding and sliding element for supporting the second rail running element. During usage of the work surface, the holding and sliding element is located either under the first running rail element or is supported on the sloped bearing surface of the first running rail element.

9 Claims, 3 Drawing Sheets

TABLE WITH MOVABLE WORKING SURFACE

FIELD OF THE INVENTION

The invention concerns a table with a movable working surface placed on top of a table frame having legs. On each of the two opposing sides the table has a running rail, which cooperates with a form-fitting edge rail installed on the underside of the working surface.

BACKGROUND OF THE INVENTION

It is generally known, that the guided movement of a table surface can be accomplished by means of installed edge rails beneath the table surface in combination with running rails arranged on the sides of the table support or the table legs. With an apparatus of this kind one can, for example, make a table surface movable on a table frame. It is also known in principle to tilt working surfaces of tables, for ergometric reasons, relative to the bearing plane of the working surface. Especially drawing tables of plastic material are equipped today with simple folding mechanisms, which make a specific tilting position possible, for example through upward folding of the working surface and locking with tightening elements. However, the danger of failure of these elements is evident with tilting or folding apparatus according to the prior art and can cause damage to or destruction of the tilting or folding mechanisms, particularly of heavy, massive working surfaces or tables, for example of massive wood. For the purpose of a healthy working place climate, it is especially desirable to use natural materials, for example massive wood.

In view of this, the invention has as its object to develop a table with a movable working surface relative to the prior art, so that also heavy, massive working surfaces, especially of massive wood, can be securely fixed at a certain inclination and horizontal relative to the support plane of the table frame, with simultaneously simple and force-saving handling, in order to achieve ergonomically favorable working conditions for the user. Also, the construction should be as simple and economical as possible to produce.

SUMMARY OF THE INVENTION

These objects are achieved according to the invention in which the working surface is movable in relation to the table frame in a running rail arrangement and is fixable in an inclined position from the horizontal plane by a fastening element at a pivot point at the front end of the running rail arrangement.

In a particular embodiment of the present invention the table frame has a running rail arrangement at both opposing sides, each cooperating with a form-fitting edge rail installed on the underside of the working surface. The running rail arrangement is divided into two running rail elements, one of the running rail elements being rigidly mounted on the table frame, and the other running rail element being rotationally coupled at a point opposite to the rigidly installed running rail element. The rigidly mounted running rail element has a sloped bearing surface, on which the movable running rail element lies in the level position of the working surface. The edge rail has a holding and sliding element which constrains the movable running rail element on its underside. Under conditions of use of the working surface, the holding and sliding element is either located under the rigid running rail element or in the tilted position of the working surface lies on the sloped bearing surface of the rigid running rail element.

Through this, one can achieve the neat and exact guiding of the working surface in a level position, as well as the energy-saving and simple positioning in a pushing/tilting process to achieve a definite inclination.

By placing a two-part running rail on each of the two short table sides, one can combine the secure guiding during pushing and the ability of tilting. To this end a running rail element, which lies away from the sitting position (i.e. to the rear of the table), is rigidly connected with the table frame, for example by screws or other fastening means with, for example, a rear table leg and a connecting element which joins the two table legs arranged on the short table side. During simultaneous movement of the front (second) running rail element in reference to a certain rotation axis at a right angle to the common longitudinal axis of the two running rail elements, but stationary in the axial longitudinal direction, as a guide for the edge rail of the table surface, one can achieve a tilting movement of the surface, whereby this tilting movement can proceed by a rotation about the pivot axis, as soon as the rear (first) running rail element is no longer engaged by the respective edge rail.

Compared to rigid, one is to understand that the running rail element, which lies closest to the table front side, has its rear end upwardly pivotable around its front end, so that the front end of the running rail element is formed as a rotational joint. Hence, this running rail element with its rear end pivoted upwards can serve as a support for the working surface, whereby the working surface assumes such a steeply angled position that it can be used as a drawing board. The downward pivoting of this running rail element is avoided by holding it in place in its aligned position by means of a pin or another fastening element, for example. The rotation joint can consist of a tightening element, for example, a rotating gripping knob.

In principle it is only necessary to pull the table surface so far out front until the first (rear) running rail element is released. Then, by means of light pressure on the front table surface area which extends beyond the frame of the table, a tilting of the table surface, that is, a rotation around the rotation axis can be achieved. By use of suitable locking or tightening means a desired inclination of the table surface position is made possible.

Especially during the usage of chairs, in particular office chairs, whose sitting surface and leaning surface are adjustable, regular tables always render the adjustment of these surfaces useless, when the working position at the table, especially at a working table, is taken by the user, since his back must leave the leaning support of the chair, in order for him to stay at the working table. By pulling the working surface towards him, the user can now keep his back against the chair back support, and therefore maintain a continuous ergonomically advantageous position with the upper body in an unstressed, relaxing working position. In addition to this there is the positive influence of tilting the working surface to a desirable inclined position. If desired, the user can have the front edge of the working surface rest on or keep off of his upper thighs. A further advantage consists in that a drawing apparatus can be attached at the rear edge of the tiltable working surface if so desired.

Additional advantageous embodiments of the invention include the following. In principle, the first back running rail element is defined by a front edge (i.e. the edge facing the table front side) which slopes upwardly toward the table back side and by its maximal height serving as the sloping support for the inclined table surface. For this purpose, not only the rigid back running rail element, but also the front running rail element, on its edge facing the table back side, should be sloped, the latter sloping downwardly from top to bottom toward the table front side, whereby the sloping edges of both running rail elements of each table short side are essentially complementary to each other. Consequently, by exertion of pressure directed on the table back edge with the table surface fixed in its forward and raised position (i.e. rotated around its pivot axis), an easy and energy saving sliding of tee edge rail on the rear first running rail element is achieved.

Further, in production of an essentially complementary slope, the two running rails can be advantageously manufactured from a single rectangular board with a dividing cut. Generally, it is possible to manufacture the running rails from any suitable material, but especially from a plastic material.

In a particular embodiment, the edge rail displays on its underside a profile which increases toward the table front side, thereby strengthening the edge rail, and this increasing profile can be multi-stepped. As a result, the working surface can be adjusted to various tilting angles or planes. This can be accomplished as well without steps using a continuously sloping profile or gradually with an intermittent profile.

It is further advantageous, in order to ensure a simple and secure guiding of the working surface on the table frame in combination with the running rail elements, to provide the edge rail with slotlike aperture guides, which extend parallel to the longitudinal groove in each edge rail and are in engagement with the longitudinal grooves. For this purpose it is especially useful that the slotlike aperture guides extend in length from an area in the edge rail close to the table front side to approximately the area corresponding to the rear edge of the second (front) running rail element. The rear end of the slotlike aperture in the edge rail thereby must be located at least so far from the front end of the slotlike aperture that when pushing (or pulling) the working surface forward, at least the first rear running rail element is completely released from the edge rail. Only through this is a tilting of the working surface at all possible.

It is especially useful to connect the edge rails with the working surface by a dovetail joint, since a high degree of stability is achieved thereby for the entire construction.

In another modified embodiment, especially for large working or writing tables, the entire working or table surface is not designed to be movable or tiltable, but only a part of the working or table surface.

In order to move the working surface from its frontmost pushed position, by exerting force on the table surface front edge, into a fixed self-sustaining position, a locking or tightening element is required. This element advantageously sticks through the slotlike aperture in the edge rail and through the second (front) running rail element into the table frame and defines thereby both an essentially stationary construction of the second running rail element co-axial with the edge rail and a rotation axis, at a right angle thereto, around which the second running rail is pivotably arranged. The tightening element has for this purpose a nut element, a bolt element, and a locking handle, whereby the bolt element extends through the slotlike guide in the edge rail and through the second running rail element into the table frame. There the bolt is secured by the nut element and simultaneously on its other end is tightenable on the edge rail by the locking element. By means of the locking element, which for example can be embodied as a knob screw or rotating handle, the working surface, either in its level position or in its tilted position is held firmly and securely. As already stated, the table with its movable working surface, may be made of massive wood. In principle, the table can also be made of pressed boards, plastic or metal.

BRIEF DESCRIPTION OF THE DRAWINGS

The foregoing summary of the invention, as well as the following detailed description of the preferred embodiment, will be better understood when read in conjunction with the appended drawings. For the purpose of illustrating the invention, there is shown in the drawings an embodiment which is presently preferred, it being understood, however, that the invention is not limited to the specific arrangement and instrumentalities disclosed.

DETAILED DESCRIPTION OF THE PREFERRED EMBODIMENT

The orientation for the explanation of the invention is based upon the sitting position of a person at the working table. The side of the working surface facing the sitting position is designated, for example, the front side, and the corresponding direction is designated as toward the front side of the table. For the reverse direction there are analogous definitions. Also, the two sides of the table, which are not front or rear sides, are designated short sides of the table.

It should be noted at this point, that in the description of the figures, only one short side of the table and the corresponding adjustment mechanism are referenced. However, for optimum functioning it will be understood that the adjustment mechanism with its individual parts must be provided in duplicate for each table, namely on each short side of the table.

Figure 1:
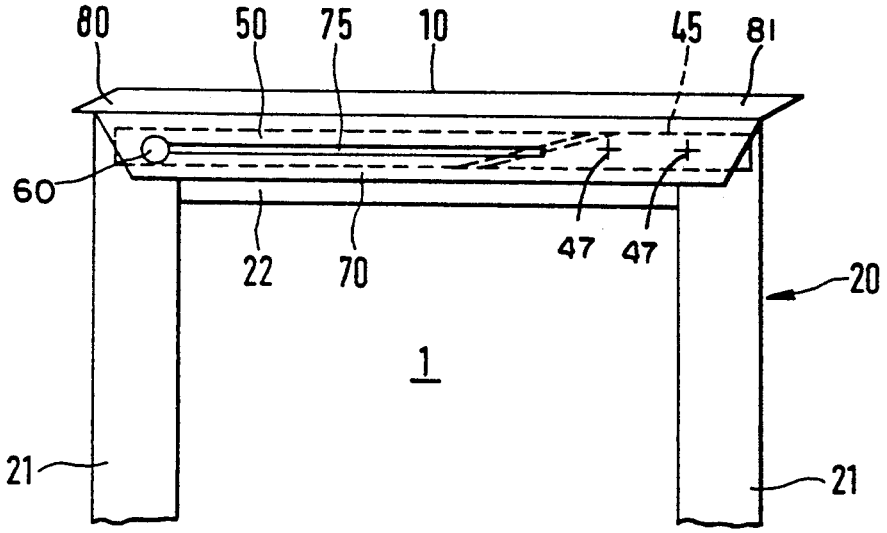
FIG. 1 is a side view of an embodiment of the new working table, wherein the running rail elements, which are covered by edge rail, are displayed in dotted lines.

The embodiment of the invention illustrated in FIG. 1 shows a side view of a working table 1. This has a table frame 20 with table legs 21. Both visible table legs 21 are connected and stabilized at their upper ends by a cross support 22. On the table frame 20, the working surface 10 is placed, which can have a front beveled edge 80, as well as a rear beveled edge 81.

At the side and underneath the working surface 10, where the surface extends past the table frame 20, there is provided parallel to the short side of the table 1 an edge rail 70, in which one can see a slotlike aperture 75. The slotlike aperture 75 extends from an area, which corresponds to the front table leg 21 up to an area that is located in the rear half of edge rail 70 related to the table backside. Received in the edge rail 70 is a two-part running rail 40, shown in dotted lines, which comprises a first running rail element 45 near the table back side and a second running rail element 50 near the table front side. The running rail elements 45, 50 are arranged parallel to the edge rail 70 between the table frame 20 and edge rail 70. At the same time the two-part running rail 40 is in total shorter than the short side of working table 1.

Figure 2:
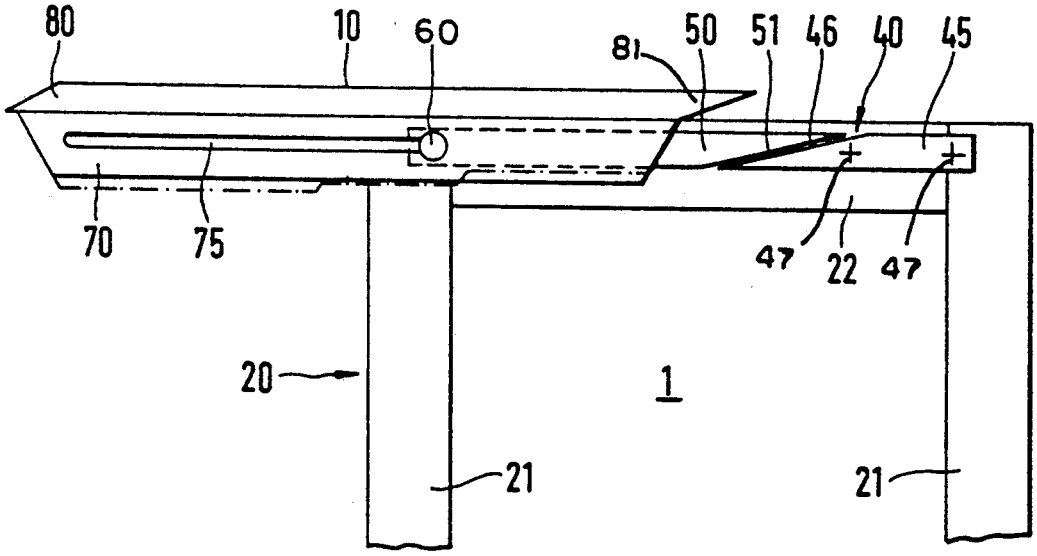
FIG. 2 is a view similar to FIG. 1, wherein the working surface is in its frontmost position.

In FIG. 2 one can see that the first running rail element 45 is connected by means of two fastening elements, namely screws 47, which are connected tightly to the table frame 20, in part with a table leg 21 and in part with the cross support 22.

Also, one can see a tightening element 60 in FIG. 1, which in the displayed level basic position of the working surface 1, passes through the extreme point of the slotted guide 75 nearest the table front side in the edge rail 70, through the second running rail element 50 into the table frame 20, particularly into the table leg 21, and fixes the working surface 10 in such a manner in its normal position as illustrated in FIG. 1.

Figure 4:
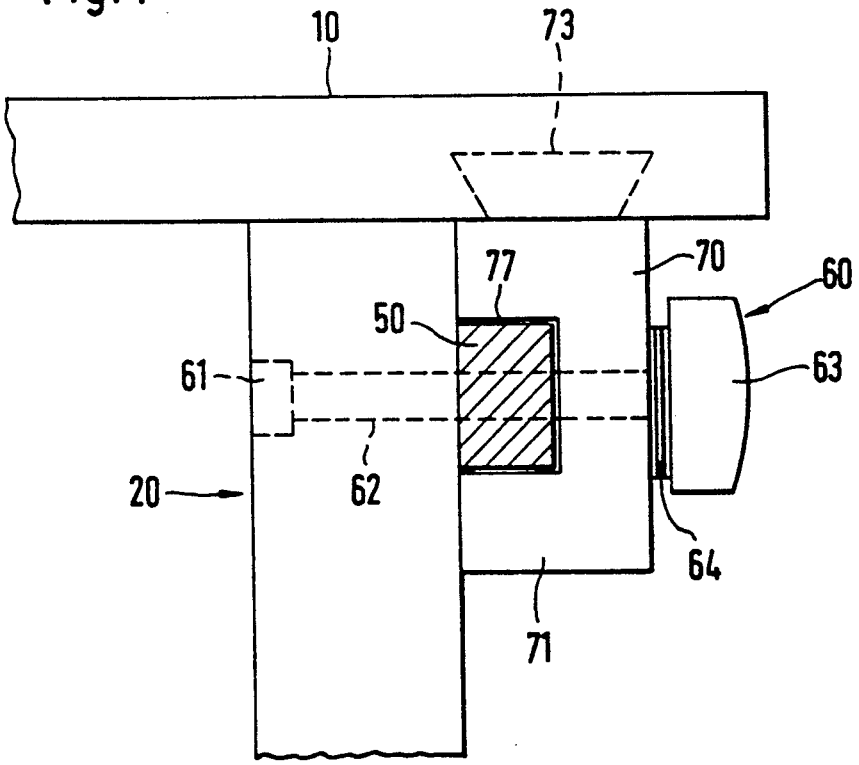
FIG. 4 is enlarged front view in the area of the pivot point.
Figure 5:
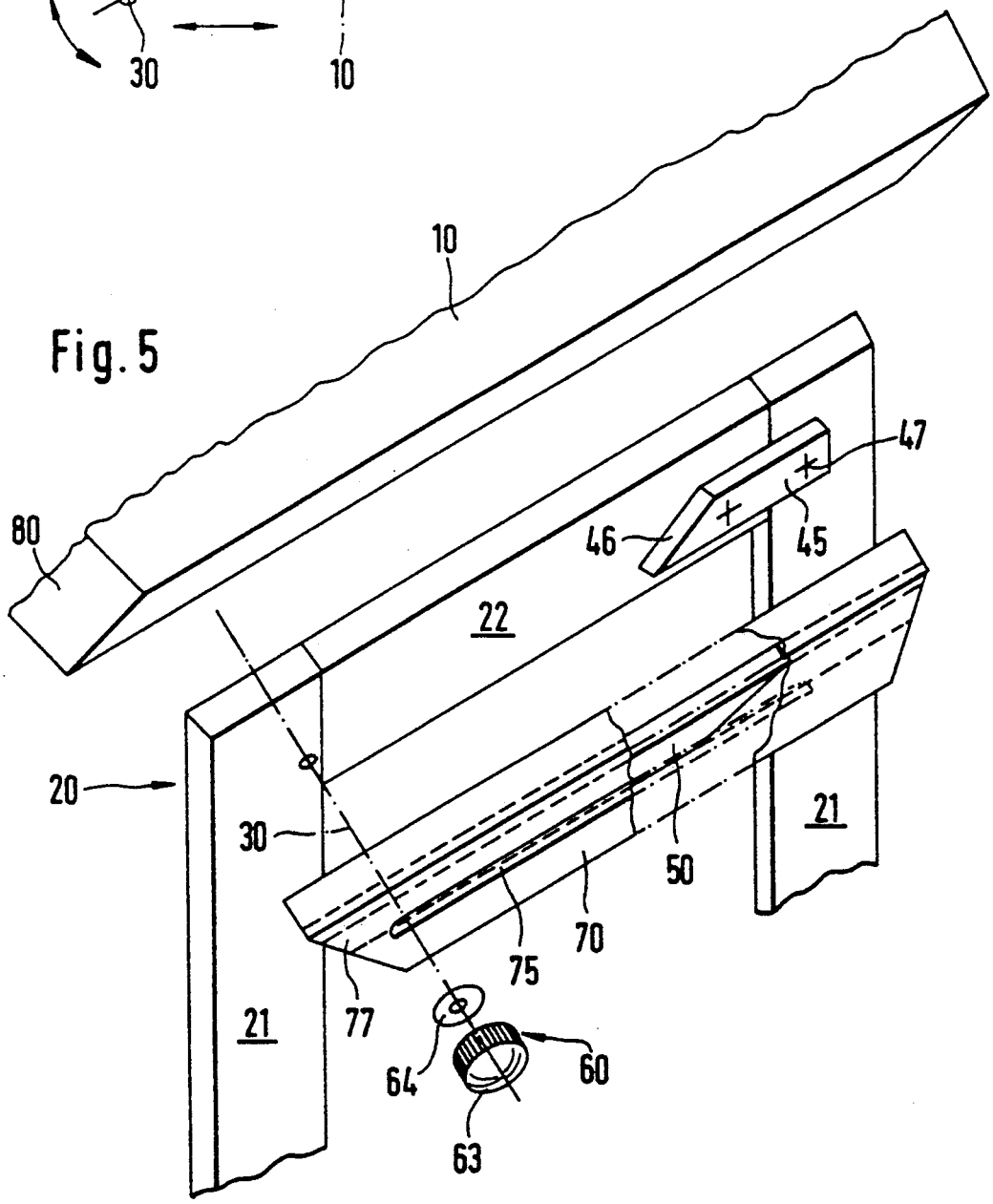
FIG. 5 is a partial perspective view of the table short side of an embodiment of the invention in the area of the guiding arrangement for the working surface on the table frame.

From FIGS. 4 and 5 one can most easily understand the construction of the tightening element 60, as well as the structure and tightening of edge rail 70.

The edge rail 70 displays a longitudinal groove 77 which faces the table short side. This has been adapted in its profile to the running rail 40. In particular, the longitudinal groove 77 extends the whole length of edge rail 70. The underside of the edge rail 70, which also borders the underside of the longitudinal groove 77, can be selected as desired. In general, this part of edge rail 70 can be embodied as a holding and carrying element 71, for example by means of at least one pin, which impinges on the underside of the movable running rail element 50 and thereby forms the lower border of longitudinal groove 77. In any case, it must be assured that the movable running rail element 50 cannot, either in the pulled out or in the pushed back position of the working surface 10, be downwardly tilted away.

Further, the edge rail 70 is preferably anchored into the working surface underside by means of a dove tail form 73, so that the longitudinal groove 77 receives the running rail 40 exactly, whereby the distance of the edge rail 70 from the table frame 20, as well as the distance of the working surface 10 from the running rail 40, is exactly determined through this special arrangement, and an easy moving of the guided working surface 10 is possible.

The edge rail 70 can in a particular embodiment have at its underside an increasing edge towards the front side of the table 1, in order to strengthen the profile of the edge rail, which can slope upwardly in a multi-step manner, as can be seen by the dashed lines in FIG. 2.

The fastening element 60 comprises a nut element 61, a bolt element 62, a tightening element 63, as well as advantageously at least one washer 64. The illustrated threaded anchor nut 61 is fastened in the opposing side of the table frame 20, which corresponds to the running rail element 50. A threaded bolt 62 in combination with the screw knob 63 and a washer 64 permits the tightening of the edge rail 70 and thereby of the entire working surface in the desired position.

In the following, the effectiveness and the useful operation of the new working table 1 are described.

If the table surface 10 is to be tilted, then the fastening element 60 is first loosened, so that by means of the parts of the fastening element which are accessible from the outside, for example the screw knob or gripping element 63, the pressure which is exerted against the table frame 20, the second running rail element 50 and edge rail 70 can be released. Then the working surface can be pulled forward manually in the direction of the table front side, with little use of force, from the position shown in FIG. 1 to the position shown in FIG. 2. The working surface is guided in this movement by running rails 40. The working surface must be moved at least so far in the direction of the table front side, relative to the table frame 20, that the first rear running rail element 45 can be released completely from the edge rail 70. In such a position, it is at first possible, by usage of pressing force on the upper side of working surface 10 by use of a leverage effect, to achieve a tipping of the working surface 10 around the pivot point 30. However, too far pulling out of the working surface 10 is avoided by the appropriate length of the slotlike aperture 75 in the edge rail 70. Hence, a tipping over of the entire working surface 10 or a falling over of the table 1 under influence of its own gravity through handling mistakes is essentially prevented.

When the working surface 10 is in the position displayed in FIG. 2, then by light pressure on the table surface top side in the area extending past table frame 20, the surface may be rotated about pivot point 30. By simultaneous exertion of a downward and backward directed pressure a soft gliding of the working surface 10 is achieved in the direction of the table back side. This sliding movement of the table surface 10 is guided by the running rails 50 and the edge rails 70. Since the first running rail element 50, as well as the working surface 10 swings at the pivot point 30 around the rotation axis, which is defined by the line connecting the two opposite threaded bolts 62, the edge rail glides on the slanted face side 46 of the first running rail element 40 during pushing back of the working surface.

Figure 3:
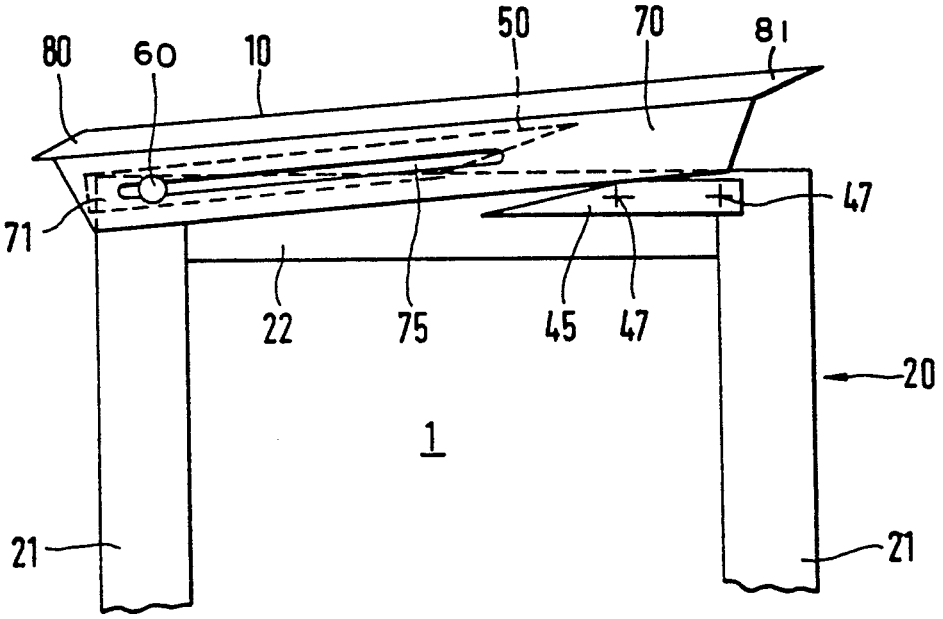
FIG. 3 is a view similar to FIGS. 1 and 2, wherein the working is in its pushed back and tilted position.

In FIG. 3 one can see that, in effect, the working surface is raised in its rear area around the height of the running rail 40, especially the second running rail element 45, while the front area of the working surface 10 remains at its original height. The maximum backward extent of movement of the working surface is once again determined by the slotlike aperture 75 in the edge rail 70 in combination with the fastening element 60. The thus achieved tilting of the working surface can be frozen in place by again operating the fastening element 60, that is, by tightening the screw knob 63.

Figure 6:
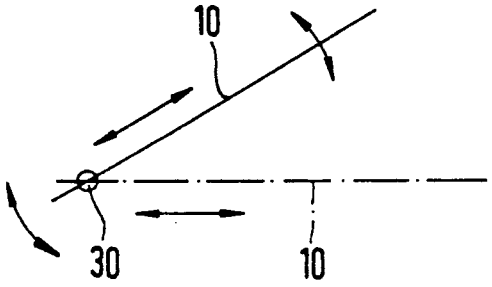
FIG. 6 is a schematic diagram to clarify the directions of movement of the working surface.

FIG. 6 shows in a schematic diagram, by arrows, the possible movement directions of the working surface 10 which can be obtained individually or in combination with each other.

For the return of the working surface to its normal position, exactly the reverse steps are taken. Loosening of the fastening element 60, pulling the working surface 10 up forward to the end position, which is determined by the slotlike aperture 75, pushing the working surface back, so that the first running rail element 40 again engages the edge rail 70 and can be completely received therein, until the front end of the slotlike aperture 75 prevents a further pushing back of the working surface 10. Finally, the surface is screwed tightly into the desired position with the fastening element.

An easy, energy-saving and secure movement and tilting even of heavy, massive working surfaces are made possible through this described construction.

The present invention may be embodied in other specific forms without departing from the spirit or essential attributes thereof and, accordingly, reference should be made to the appended claims, rather than to the foregoing specification as indicating the scope of the invention.

I claim:

1. A table comprising:

a table frame having a plurality of legs extending therefrom;

a horizontally movable working surface supported on the table frame, said working surface being pivotable from a horizontal position to an inclined position;

first and second running rail means provided on the table frame for controlling the movement of the work surface with respect to said table frame, each running rail means comprising two running rail elements including a first running rail element, having a first and second end, rigidly attached to the table frame and a second running rail element, having a first and second end, mounted to the table frame at a location adjacent to the first running rail element, said first end of said second running rail element being pivotally mounted to said table frame such that said second running rail element is rotatably mounted to the table frame, said first end of said first running rail element having a sloped support surface on which the second end of the second running rail element lies on when the working surface is in the horizontal position;

a pair of edge rails extending from said working surface, each edge rail receiving said first and second running rail elements of one of said running rail means in a form fitting relationship when said working surface is in the horizontal position and receiving said second running rail element of one of said running rail means when said work surface is in said inclined position;

a holding and sliding element mounted on an underside of each edge rail for being supported by said first running rail element of one of said running rail means when the working surface is in the inclined position such that holding and sliding element is located on the sloped surface of the first running rail element and underneath said second running rail element of the one running rail means, said holding and sliding element being located underneath the first and second running rail elements of one of said running rail means when the working surface is in the horizontal position; and tightening means for securing said working surface in place when said working surface is in the inclined position.

2. A table according to claim 1, wherein the second end of each second running rail element (50) includes a sloped surface, whereby the sloped surfaces of each of the surfaces of the first and second running rail elements are complementary to each other.

3. A table according to claim 2 wherein the first and second running rail elements (45, 50) are made by a single cut of a rectangular block.

4. A table according to claim 1, wherein each edge has a slotlike aperture (75) which extends parallel to and in communication with a longitudinal groove (77) formed in said edge rail.

5. A table according to claim 4, wherein each slotlike aperture (75) generally extends in length from the first end of the corresponding second running rail element to the second end of the corresponding second running rail element (52).

6. A table according to claim 4, wherein each second running rail element (50) is pivotally mounted by the tightening means (60), which extends through the slotlike aperture (25) of each edge rail and through the second running rail element (50) into the table frame (20), to form an essentially stationary rotation axis (30) at a right angle to the second running rail element (50).

7. A table according to claim 6, wherein said tightening means (60) comprises a nut element (61), a bolt element (62), and a tightening element (63), wherein the bolt element (62) extends through the slotlike aperture (75) in each edge rail (70) and through the second running rail element (50) into the table frame (20), said bolt element (62) being held at a first end by the nut element (61) and simultaneously fastened at a second end to the tightening element (63) which may bear against the edge rail (70).

8. A table according to claim 1, wherein each edge rail is connected to the working surface by a dovetail joint.

9. A table according to claim 1 wherein the working surface (10), table frame (20), and running rail elements (45, 50) are made of massive wood.

* * * * *